US008509034B2

(12) United States Patent
Klinge

(10) Patent No.: US 8,509,034 B2
(45) Date of Patent: Aug. 13, 2013

(54) HYDROPHONE AND HYDROPHONE ASSEMBLY FOR PERFORMING STEREOPHONIC UNDERWATER SOUND RECORDINGS

(76) Inventor: Timo Klinge, Munich (DE)

( * ) Notice: Subject to any disclaimer, the term of this patent is extended or adjusted under 35 U.S.C. 154(b) by 142 days.

(21) Appl. No.: 13/083,845

(22) Filed: Apr. 11, 2011

(65) Prior Publication Data

US 2011/0242943 A1 Oct. 6, 2011

Related U.S. Application Data

(63) Continuation of application No. PCT/EP2009/007318, filed on Oct. 12, 2009.

(30) Foreign Application Priority Data

Oct. 11, 2008 (DE) ..... 10 2008 050 728

(51) Int. Cl.
*G10K 11/00* (2006.01)

(52) U.S. Cl.
USPC ..... 367/173; 367/176; 367/188; 367/131; 367/153; 310/337

(58) Field of Classification Search
USPC ..... 367/163, 172, 174, 131, 141, 153, 367/173, 176, 188; 381/191; 310/337
See application file for complete search history.

(56) References Cited

U.S. PATENT DOCUMENTS

| | | | | |
|---|---|---|---|---|
| 3,221,296 | A * | 11/1965 | Milne | 367/46 |
| 3,732,535 | A * | 5/1973 | Ehrlich | 367/164 |
| 3,805,226 | A * | 4/1974 | Holloway | 367/157 |
| 3,887,896 | A * | 6/1975 | Ramstedt | 367/116 |
| 4,974,213 | A | 11/1990 | Siwecki | |
| 5,579,284 | A * | 11/1996 | May | 367/132 |
| 6,545,948 | B1 | 4/2003 | Jiang | |

FOREIGN PATENT DOCUMENTS

| | | |
|---|---|---|
| FR | 2 657 213 | 7/1991 |
| GB | 2 144 308 | 2/1985 |

* cited by examiner

*Primary Examiner* — Ian Lobo
(74) *Attorney, Agent, or Firm* — Mayback & Hoffman, P.A.; Gregory L. Mayback

(57) ABSTRACT

A hydrophone for recording underwater sound includes a housing having an outer surface designed to serve as a boundary surface for an incident sound wave and at least one vibration sensor having a sensor surface for recording sound waves and for preparing a sensor signal. The sensor surface of the vibration sensor is in an opening of the housing. A hydrophone assembly includes a plurality of the hydrophones.

16 Claims, 5 Drawing Sheets

HYDROPHONE AND HYDROPHONE ASSEMBLY FOR PERFORMING STEREOPHONIC UNDERWATER SOUND RECORDINGS

CROSS-REFERENCE TO RELATED APPLICATIONS

This is a continuing application, under 35 U.S.C. §120, of copending international application No. PCT/EP2009/007318, filed Oct. 12, 2009, which designated the United States and was not published in English, and this application also claims the priority, under 35 U.S.C. §119, of German patent application No. 10 2008 050 728.8 filed Oct. 11, 2008, the entire disclosures of these applications are hereby incorporated herein by reference in their entireties.

STATEMENT REGARDING FEDERALLY SPONSORED RESEARCH OR DEVELOPMENT

Not Applicable

FIELD OF THE INVENTION

The present invention relates to hydrophones and hydrophone assemblies for performing stereophonic underwater sound recordings.

BACKGROUND OF THE INVENTION

Hydrophones for recording underwater sound are known in the art. Such hydrophones are, for example, in the form of spheres having a diameter of 2 cm to 4 cm. The outer sphere surface includes a piezoelectric material that generates an electrical signal corresponding to the underwater sound by the piezoelectric effect upon impinging sound waves.

Also known are hydrophones having a planar sensor area, the physical effect of which is also based upon the piezoelectric effect.

For performing stereophonic acoustic underwater recordings, directivity of the applied hydrophones is desirable that is also present in an audible frequency range. Currently, however, there are no hydrophones available that provide a corresponding directivity in a range from 20 Hz to 20 kHz for facilitating stereophonic recordings. Moreover, the response characteristic of a conventional piezoelectric spherical hydrophone is too fast, so that acoustical sound recordings sound unfamiliar and distorted to the human ear.

Nevertheless, in order to facilitate stereophonic recordings, hydrophone configurations in the form of a chain or a matrix have been used up to now. The signals thus recorded are evaluated utilizing propagation time effects, which leads to the generation of comb filter effects due to phase shifts, which also has a negative influence on the sound perception.

In the case of underwater video recordings, it is desirable to improve the overall impression to accompany the underwater video recordings with recordings of stereophonic underwater sound in an audible frequency range and in an undistorted manner, i.e., with as little distortion as possible. However, the chain or matrix configurations of hydrophones usually have a size that underwater movement, e.g. by a diver conducting the underwater video recordings, is not possible.

There are military systems in use including a large number of sound converters. The signals recorded by the sound converters are electronically assembled to form one single signal. It is possible to alter the propagation times of the different signals. With this technology, it is possible to calculate one highly focused signal from the undirected individual signals using excessive computing power. It is disadvantageous that such systems demand a high implementation effort and require computing power.

It is a problem underlying the prior art to provide a hydrophone and a hydrophone assembly by which it is possible to perform stereophonic underwater sound recordings in a frequency range from 1 kHz to 30 kHz, in particular, in an audible frequency range, with very low distortion.

Thus, a need exists to overcome the problems with the prior art systems, designs, and processes as discussed above.

SUMMARY OF THE INVENTION

The invention provides a hydrophone and hydrophone assembly for performing stereophonic underwater sound recordings that overcome the hereinafore-mentioned disadvantages of the heretofore-known devices and methods of this general type and that provide such features in an audible frequency range.

With the foregoing and other objects in view, there is provided, in accordance with the invention, a hydrophone for detecting underwater sound including a housing having an outer surface serving as a bounding surface for an impinging sound wave and defining an opening and at least one vibration sensor having a sensor area for receiving sound waves and operable to provide a sensor signal, the sensor area being in the opening of the housing.

With the objects of the invention in view, there is also provided a hydrophone assembly includes a plurality of hydrophones for detecting underwater sound, each hydrophone comprising a housing having an outer surface serving as a bounding surface for an impinging sound wave and defining an opening and at least one vibration sensor having a sensor area for receiving sound waves and operable to provide a sensor signal, the sensor area being in the opening of the housing.

With the objects of the invention in view, there is also provided a method for operating hydrophones for stereophonic underwater sound recordings in an audible frequency range includes the steps of placing at least two hydrophones for detecting underwater sound in water, each of the at least two hydrophones comprising a housing having an outer surface serving as a bounding surface for an impinging sound wave and defining an opening and at least one vibration sensor having a sensor area for receiving sound waves and operable to provide a sensor signal, the sensor area being in the opening of the housing, and carrying out underwater stereophonic sound recordings in an audible frequency range with the at least two hydrophones.

In accordance with another feature of the invention, the sensor area closes the opening of the housing in a flush manner.

In accordance with a further feature of the invention, the outer surface of the housing has a shape and size to obtain a directivity in an audible frequency range.

In accordance with an added feature of the invention, the housing has a spherical shape.

In accordance with an additional feature of the invention, the housing has a diameter providing a lower cut-off frequency for the directivity in an audible frequency range from approximately 50 Hz to approximately 16 kHz.

In accordance with yet another feature of the invention, the housing has a diameter between approximately 15 cm and approximately 30 cm to have the lower cut-off frequency for the directivity be between approximately 1.5 kHz and approximately 3 kHz.

In accordance with yet a further feature of the invention, there is provided a high-pass filter connected to the vibration sensor to filter the sensor signal, the high-pass filter having a cut-off frequency corresponding to the lower cut-off frequency for the directivity.

In accordance with yet an added feature of the invention, there is provided at least one housing extension element operable to be removably attached to the outer surface of the housing to form an extended outer surface and a coupling material acoustically coupling a further sensor area to the sensor area flush to the opening of the housing.

In accordance with yet an additional feature of the invention, there is provided at least one housing extension element operable to be removably attached to the outer surface of the housing to form an extended outer surface and a coupling material acoustically coupling a further sensor area to the sensor area flush to the extended outer surface.

In accordance with again another feature of the invention, the housing is ellipsoid in shape and the at least one vibration sensor is a plurality of vibration sensors disposed in one plane, the vibration sensors each have a sensing direction as a direction of highest sensing sensitivity and the sensing directions of two of the vibration sensors form an angle between approximately 110° and approximately 150°.

In accordance with again a further feature of the invention, the vibration sensors include an inner vibration sensor disposed between the two outer vibration sensors, the inner vibration sensor having a sensing direction directed along a bisecting line of the angle between the sensing directions of the two outer vibration sensors, the sensing directions of the outer and inner vibration sensors are directed toward a first half space.

In accordance with again an added feature of the invention, the vibration sensors include two further vibration sensors having different sensing directions directed towards a second half space different from the first half space, the two further vibration sensors being disposed such that a bisecting line of an angle between the sensing directions thereof and the bisecting line of the angle between the sensing directions of the two outer vibration sensors are one of parallel and identical.

In accordance with again an additional feature of the invention, the plurality of hydrophones is at least three hydrophones disposed in a serial configuration.

In accordance with still another feature of the invention, each two neighboring ones of the serially configured hydrophones have the same distance to each other.

In accordance with still a further feature of the invention, the hydrophones each have a sensing direction corresponding to a direction of the highest sensing sensitivity thereof and the sensing directions of two outer ones of the hydrophones form an angle from approximately 110° to approximately 150°.

In accordance with still an added feature of the invention, an inner one of the hydrophones is disposed between two outer ones of the hydrophones, a sensing direction of the inner hydrophone is directed along a bisecting line of the angle between the sensing directions of the outer hydrophones, and the sensing directions of all serially configured hydrophones are directed towards a first half space.

In accordance with a concomitant feature of the invention, the hydrophones comprise two further hydrophones each provided with different sensing directions directed towards a second half space different from the first half space and forming an angle therebetween of approximately 70° to approximately 110° and the further hydrophones are disposed so that a bisecting line of the angle between the sensing directions thereof and the bisecting line of the angle between the sensing directions of the outer hydrophones of the serially configured hydrophones are one of parallel and identical.

According to a first aspect of the invention, a hydrophone is provided for recording underwater sound. The hydrophone comprises:

a housing having an outer surface that is adapted to serve as a bounding surface for an impinging sound wave; and at least one vibration sensor having a sensor area for receiving sound waves and for providing a sensor signal, wherein the sensor area of the vibration sensor is arranged in an opening of the housing.

Furthermore, the sensor area can close the opening of the housing in a flush manner.

It is one idea of the above hydrophone that it is assembled with a vibration sensor for receiving underwater sound having a substantially undirected recording characteristic or a non-distinct directivity that is not sufficient for stereophonic sound recordings and with a suitable housing to generate the directivity that is required for stereophonic underwater sound recordings. To this end, the hydrophone is disposed, for example, in a hard-shelled housing, in particular a spherical housing, wherein a sensor area of the vibration sensor is in a region of the opening and is, in an exemplary embodiment, flush with the outer surface of the housing.

Due to the acoustical directivity of such a hydrophone, only one hydrophone per audible channel is required. Further signal processing is not needed.

Since directivity is required for stereophonic sound recordings, the size and shape of the outer surface of the housing are adapted such that the directivity is also present underwater in an audible frequency range.

According to one exemplary embodiment, the spherical housing can have a diameter by which a lower cut-off frequency for the directivity is achieved that is in an audible frequency range from approximately 50 Hz to approximately 16 kHz. In particular, the housing can have a diameter from approximately 15 cm to approximately 30 cm, so that the lower cut-off frequency for the directivity is between approximately 1.5 kHz and approximately 3 kHz. Underwater sound cannot be recorded in a directed manner in a lower frequency range since these frequencies are not sufficient for the bounding surface formed by the outer surface of the housing, in particular where the housing has a spherical shape. As shorter wavelengths waves dam up at and propagate around the spherical surface, the directional information of the hydrophone is lost at lower frequencies. The cut-off frequency thus directly depends on the size of the outer surface of the housing. Consequently, the directivity required for stereophonic sound recordings only exists above the lower cut-off frequency for the directivity. As the degree of directivity of spherical surfaces cannot be calculated, the diameter for the desired cut-off frequency must be determined in an empirical manner.

According to one exemplary embodiment, the vibration sensor can be connected to a high-pass filter to filter the sensor signal, wherein the high-pass filter has a filter cut-off frequency corresponding to the lower cut-off frequency for the directivity. In particular, this helps avoiding a saturation of downstream amplifiers due to the low-frequency background sound.

According to one exemplary embodiment, one or more housing extension elements can be provided that are attachable to the outer surface of the housing for enlargement, so that an extended outer surface is formed, wherein a further sensor area is provided that is acoustically coupled to the sensor area that is disposed at the opening of the housing in a flush manner by a coupling material, wherein, in particular, the further sensor area is flush with the extended outer surface.

Furthermore, the hydrophone can have an ellipsoid housing in which a plurality of vibration sensors are disposed, in particular in one plane, wherein the vibration sensors each have a sensing direction as a direction of highest sensitivity, wherein the sensing directions of two of the vibration sensors form an angle between approximately 110° and approximately 150°.

According to a further exemplary embodiment, an inner vibration sensor can be disposed between two outer vibration sensors, the sensing direction of which is directed along the bisecting line of the angle formed between the sensing directions of the outer vibration sensors, and wherein the sensing directions of the outer and inner vibration sensors are directed toward a first half space.

Furthermore, two further vibration sensors can be provided with the different sensing directions, which are directed towards a second half space that is different from the first half space, wherein two further vibration sensors are particularly disposed such that the bisecting line of the angle between the sensing directions thereof and the bisecting line of the angle between the sensing directions of the outer vibration sensors are parallel to each other or, in particular, identical.

According to a further aspect, a hydrophone assembly having a plurality of the above hydrophones is provided.

According to one exemplary embodiment, at least three hydrophones can be disposed in a serial configuration. In particular, each two neighboring hydrophones of the serially disposed hydrophones have an identical distance to each other.

Furthermore, the hydrophones can each have a sensing direction that is a direction of highest sensing sensitivity, wherein two outer ones of the hydrophones form an angle between approximately 110° and approximately 150° between their sensing directions.

According to one exemplary embodiment, a hydrophone can be disposed between the two outer hydrophones, the sensing direction of which extends along a bisecting line of the angle between the sensing directions of the outer hydrophones, and wherein the sensing directions of all serially disposed hydrophones are directed towards a first half space.

Furthermore, two further hydrophones can be provided, wherein the sensing directions of the two further hydrophones are directed towards a second half space that is different from the first half space and form an angle between approximately 70° to approximately 110°, wherein the further hydrophones are disposed such that the bisecting line of the angle between the sensing directions thereof and the bisecting line of the angle between the sensing directions of the outer hydrophones of the serially disposed hydrophones are parallel to each other or, in particular, identical.

It is one idea of the above hydrophone assembly to transfer the concept of combining a plurality of sound detectors for panoramic recordings to the recording of underwater sound. The hydrophone assembly comprising the above hydrophones provides an assembly of the hydrophones such that the acoustically sensitive bounding surfaces of the two outer hydrophones are directed so that their directions of highest sensing sensitivity form an angle between approximately 110° and approximately 150° and are distanced from each other by approximately 4 m to approximately 6 m. A third hydrophone sphere can be disposed between the two outer hydrophones at an identical distance thereof. The direction of highest sensing sensitivity of the inner hydrophone preferably is a direction corresponding to the bisecting line of the angle between the directions of highest sensing sensitivity of the outer hydrophones.

Although the invention is illustrated and described herein as embodied in a hydrophone and hydrophone assembly for performing stereophonic underwater sound recordings, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Additional advantages and other features characteristic of the present invention will be set forth in the detailed description that follows and may be apparent from the detailed description or may be learned by practice of exemplary embodiments of the invention. Still other advantages of the invention may be realized by any of the instrumentalities, methods, or combinations particularly pointed out in the claims.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward.

BRIEF DESCRIPTION OF THE DRAWINGS

The accompanying figures, where like reference numerals refer to identical or functionally similar elements throughout the separate views, which are not true to scale, and which, together with the detailed description below, are incorporated in and form part of the specification, serve to illustrate further various embodiments and to explain various principles and advantages all in accordance with the present invention. Advantages of embodiments of the present invention will be apparent from the following detailed description of the exemplary embodiments thereof, which description should be considered in conjunction with the accompanying drawings in which.

DETAILED DESCRIPTION OF THE INVENTION

Figure 1:
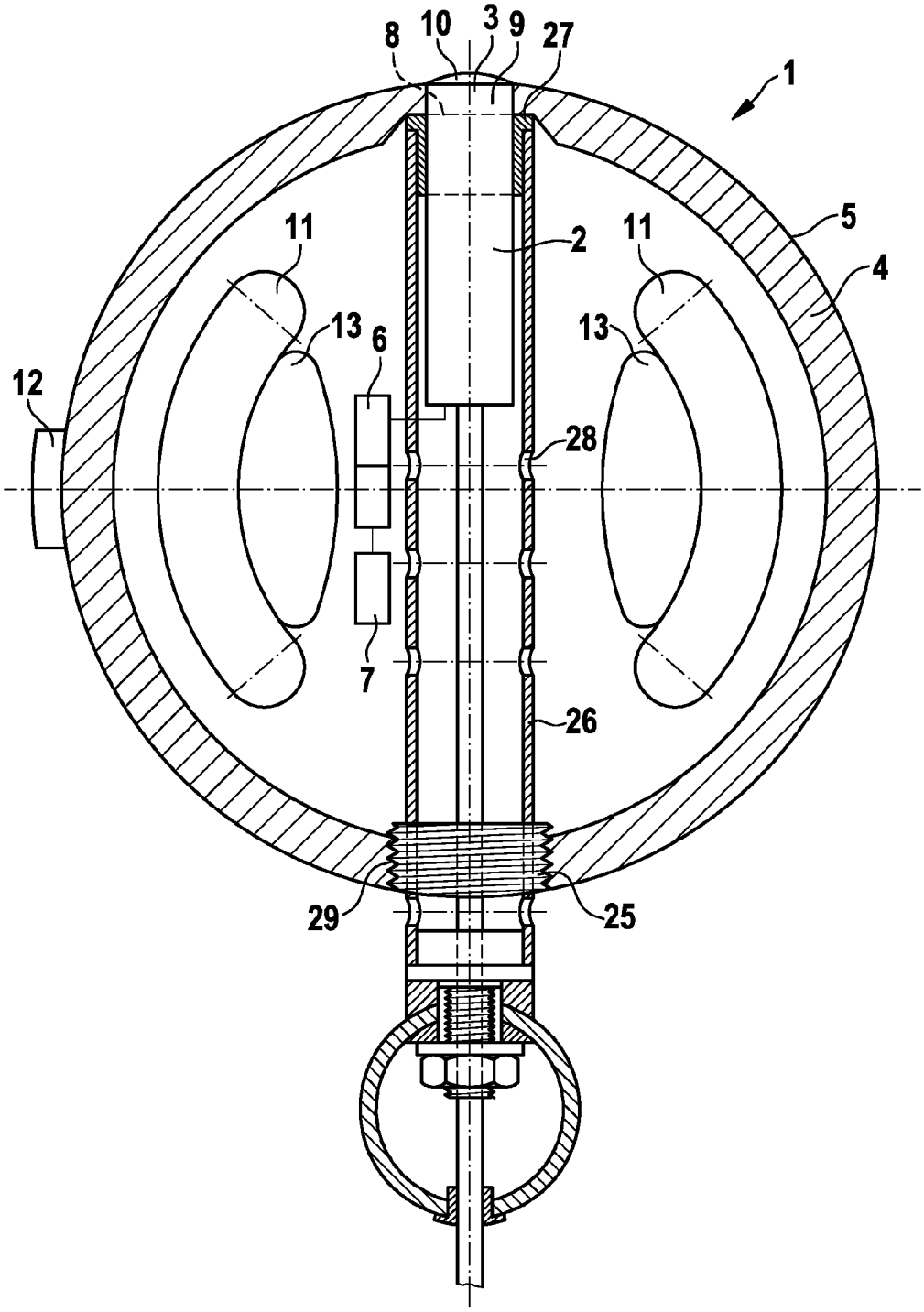
FIG. 1 is a cross-sectional view of an exemplary embodiment of a hydrophone for directed underwater sound recordings according to the invention.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward.

Alternate embodiments may be devised without departing from the spirit or the scope of the invention. Additionally, well-known elements of exemplary embodiments of the invention will not be described in detail or will be omitted so as not to obscure the relevant details of the invention.

Before the present invention is disclosed and described, it is to be understood that the terminology used herein is for the purpose of describing particular embodiments only and is not intended to be limiting. The terms "a" or "an", as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

Relational terms such as first and second, top and bottom, and the like may be used solely to distinguish one entity or action from another entity or action without necessarily requiring or implying any actual such relationship or order between such entities or actions. The terms "comprises," "comprising," or any other variation thereof are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

Herein various embodiments of the present invention are described. In many of the different embodiments, features are similar. Therefore, to avoid redundancy, repetitive description of these similar features may not be made in some circumstances. It shall be understood, however, that description of a first-appearing feature applies to the later described similar feature and each respective description, therefore, is to be incorporated therein without such repetition.

Described now are exemplary embodiments of the present invention. Referring now to the figures of the drawings in detail and first, particularly to FIG. 1, there is shown a first exemplary embodiment of a hydrophone 1 for recording underwater sound having directivity. The hydrophone 1 has a vibration sensor 2 that has an acoustically sensitive membrane 8. For converting the vibrations of the membrane 8 to electrical sensor signals, the membrane 8 can be provided with a piezoelectric material.

The vibration sensor 2 according to an exemplary embodiment is configured to adapt its frequency characteristics and response characteristics to the human sense of hearing. To this end, the vibration sensor 2 has a membrane 8 with suitable dimensions for providing the required frequency characteristics and the required response characteristics. The membrane 8 is coupled to a sensing area 3 in a suitable manner, e.g. by a damping material 9. The damping material 9 further ensures a damping of flow noise that can be developed close to the outer surface of the hydrophone 1.

Furthermore, it is possible to provide the sensing area 3, i.e., the surface of the acoustic center, with a hemispherical attachment 10 comprising a further damping material, in order to further reduce flow noise.

The hydrophone 1 preferably has a spherical housing 4. The outer surface 5 of the housing 4 is, in the exemplary embodiment, made of a solid material to form a bounding surface for underwater sound. The sensing area 3 of the vibration sensor 2 in the exemplary embodiment fits flush to the spherical outer surface 5.

The hydrophone 1 according to an exemplary embodiment is balanced for underwater sound recordings and for a better underwater maneuverability, if possible sufficient for depths down to 40 m, where such underwater sound recordings are to be carried out.

Underwater balancing can, e.g., be provided by equipping the hydrophones with a pressure chamber 11, which is externally accessible through a connector 12. The pressure chamber 11 acts on a deformable body 13, such as, e.g., a water container having an outward opening (not shown), to adjust the buoyancy of the housing of the hydrophone 1. Through the connector 12, an air tank of a diver can be directly connected to the pressure chamber 11 so that the diver can balance the hydrophone 1 according to the current water depth by letting air into and out of the pressure chamber 11.

The housing 4 of the hydrophone 1 can, e.g., be formed by or with a polystyrene sphere that is balanced by weights, e.g., lead weights. In an exemplary embodiment, the housing 4 of the hydrophone 1 can be in the shape of a hollow sphere using epoxy.

The hydrophone 1 has directivity in a frequency range the lower cut-off frequency of which is determined by the diameter of the housing 4. It is a general rule that the cut-off frequency for the directivity, below which no directivity of the recording can be achieved, becomes lower with an increasing diameter of the housing 4.

As low-frequency sound spreads underwater over very large distances, the background sound level at low frequencies is very high in underwater recordings, e.g., due to shipping traffic and the like. Thus, it is recommended to mask low-frequency underwater sound as well as possible when conducting a stereophonic recording in an underwater environment. The size of the spherical housing 4 can, therefore, be dimensioned such that the lower cut-off frequency, down to which directed recordings shall be enabled, is above the range of the low-frequency background sound that is supposed to be masked when recording.

Furthermore, a high-pass filter 6 is coupled to the vibration sensor 2. The cut-off frequency of the high-pass filter 6 is adapted to the frequency at which a directed recording with the hydrophone 1 is not possible anymore. With a diameter of the spherical housing 4 of, e.g., 4 cm to 20 cm, no directivity can be achieved at underwater sound frequencies below 2 kHz. As the low-frequency background noise, which extends across very large distances and is supposed to be masked for local stereophonic underwater sound recordings, is also in this frequency range, the high-pass filter 6 is thus preferably configured to have a cut-off frequency that approximately corresponds to the frequency of the lower cut-off frequency of the directivity. In the above example, the cut-off frequency of the high-pass filter should be about 2 kHz. As a result, a filtered electrical signal of the vibration sensor 2 is obtained that corresponds to a directed acoustical underwater sound recording.

The housing 4 of the hydrophone 1 does not necessarily have to be of a spherical shape. However, the shape of the housing 4 should allow for underwater sound waves, having a frequency below the cut-off frequency up to which directed recordings are supposed to be feasible, to move along the outer surface of the housing 4. Elliptical or other curved surface areas of the housing are, therefore, conceivable.

Since high-frequency sound is of a much lower intensity in an underwater environment, this loss of level should be compensated for by impedance matching with resistors downstream of the filter. Such resistors are adapted according to the selected cut-off frequency.

The high-pass filter 6 is connected to a pre-amplifier 7, which amplifies the electrical signal that is generated by the vibration sensor 2 and subsequently filtered in the high-pass filter 6 before the signal is transformed into a stereophonic recording signal in a recording unit for further evaluation and processing. The pre-amplifier 7 can be provided in the housing 4 of the hydrophone 1 or centrally at the location of the recording unit.

It is a further advantage of the high-pass filter 6 according to the invention that an overdrive of the downstream pre-amplifier 7 is avoided by filtering out the very high signal amplitudes of the low-frequency background sound.

The signals provided in the pre-amplifier 7 can be transferred to a recording system that is located outside the hydrophone 1 through a wired or wireless connection. In the case of a wireless transmission, the pre-amplifier 7 comprises a transmitting unit that transmits signals as radio signals to a receiving unit that is disposed directly at the housing 4 or remote thereof and is coupled to the recording unit. Thereby, it is possible to leave the surface of the housing 4 substantially intact, so that the danger of leakage is reduced and the acoustical behavior of the hydrophone 1 is not impaired. In the case of wireless transmission, an energy source, like, e.g., a battery, is provided in the interior of the housing 4 to supply the electronic components with electrical energy.

For attaching the hydrophone 1 to a suitable structure, the housing 4 can be provided with a passage 25 (in case of a hollow housing) or with a central bore (in case of a solid housing) through which a support tube 26 can be inserted. At the end of the housing 4 located opposite the passage 25, a recess 27 can be provided at the inner wall thereof, in which the support tube 26 is received and fixed to avoid lateral shifting. Thereby, it is possible to hold the hydrophone 1 at the support tube 26, so that the support tube 26 can, in particular, absorb a buoyancy force that acts underwater on the hydrophone 1. Between the support tube 26 and the passage 25, a sealing element 29 can be provided that protects the interior of the housing 4 from the intrusion of water through the passage 25 and simultaneously holds the support tube 26 in the recess 27.

The support tube 26 has a cavity for accommodating the vibration sensor 2. The sensor area 3 is disposed at the external surface opposite the recess 27 located at the interior wall of the housing 4. The support tube 26 can have one or more openings 28 in the interior of the housing 4 for electrically connecting supply lines that lead to the vibration sensor 2 and further components that are located in the interior of the housing 4. In an exemplary embodiment where the signals received are transmitted to the recording unit through a wired connection, a transmission line can be led out of the hydrophone 1 through the support tube 26.

Figure 3:
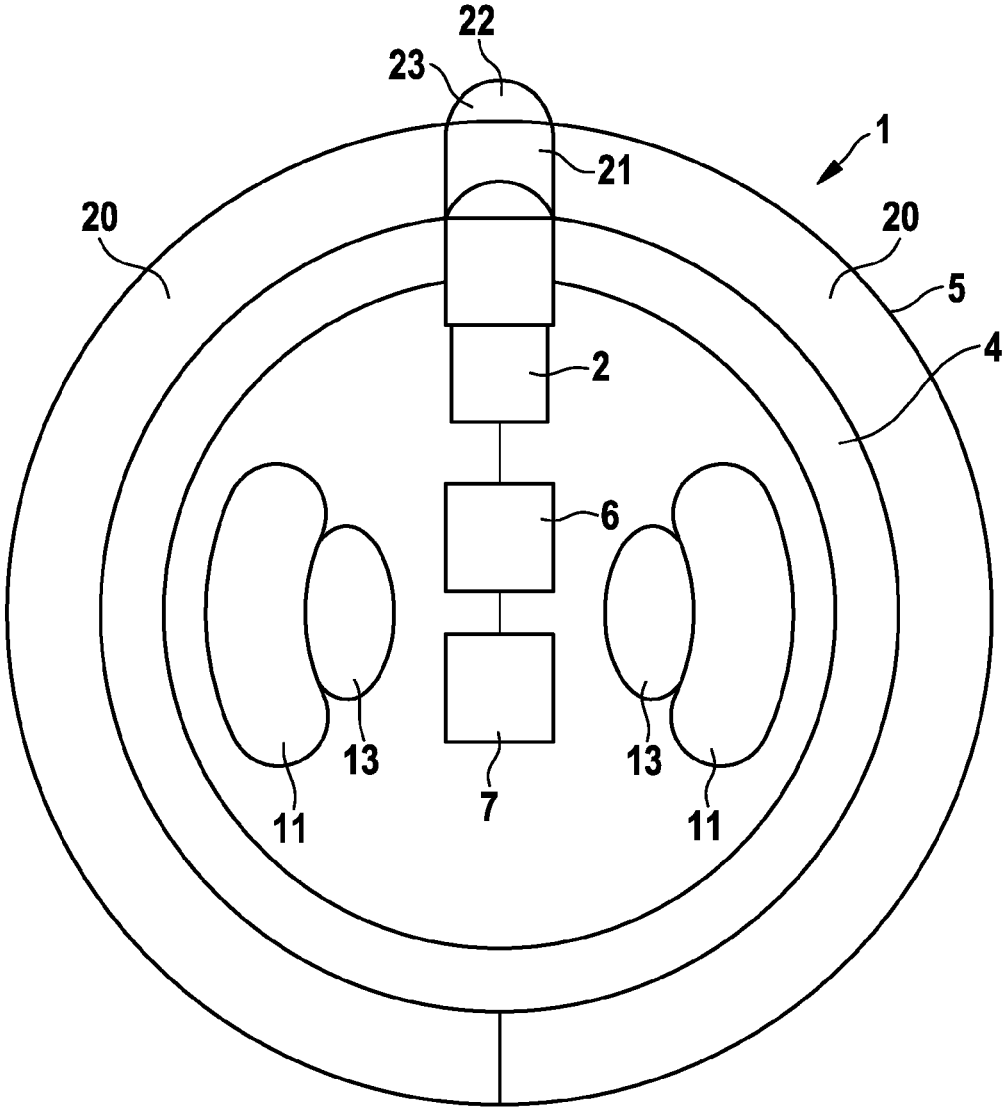
FIG. 3 is a cross-sectional view of an exemplary embodiment of a hydrophone for directed underwater sound recordings with extended outer surface according to the invention.

To adapt the hydrophone 1 to different cut-off frequencies, down to which directed sound recordings shall be carried out, it may be required to alter the shape and size of the outer surface of the housing 4. One possibility to achieve this feature is to alter the size of the spherical housing 5 of the hydrophones 1 by placing hemispherical shells 20 as housing extension elements around the housing 4 of the hydrophone 1, as illustrated in FIG. 3. To correspondingly adapt the sensor area 3 to the altered size of the hydrophone 1, a coupling body 21 is attached to one of the hemispherical shells 20 to contact or touch the hemispherical attachment 10—or the sensor area 3, in case there is no such attachment 10—when the hemispherical shells 20 are attached to the housing 4. The coupling body 21 has a further sensor area 22 that is flush with the outer surface of the hemispherical shells 20. The further sensor area 22 can be followed toward the outside by a further hemispherical attachment 23, the shape of which substantially corresponds to the shape of the hemispherical attachment 10. Thus, it is possible to extend the outer surface of the housing 4 without exerting any substantial impact on the recording characteristics of the vibration sensor 2.

From a certain flow velocity of the water flowing around the hydrophone 1, turbulences can be generated on the outer surface 5 of the hydrophone 1. As these are acoustically disadvantageous, the shape of the hydrophone 1 can be further optimized. To this end, the side of the spherical shape that faces away from the sensor area 3 can, in an exemplary embodiment, be slightly ellipsoid, i.e., streamlined or drop-shaped in a direction toward the system. Thereby, for the part of the outer surface 5 surrounding the sensor area 3, the laminar layer on the bounding surface can be maintained for higher flow velocities. Altogether, the hydrophone 1 can be of a drop-like shape.

Figure 2:
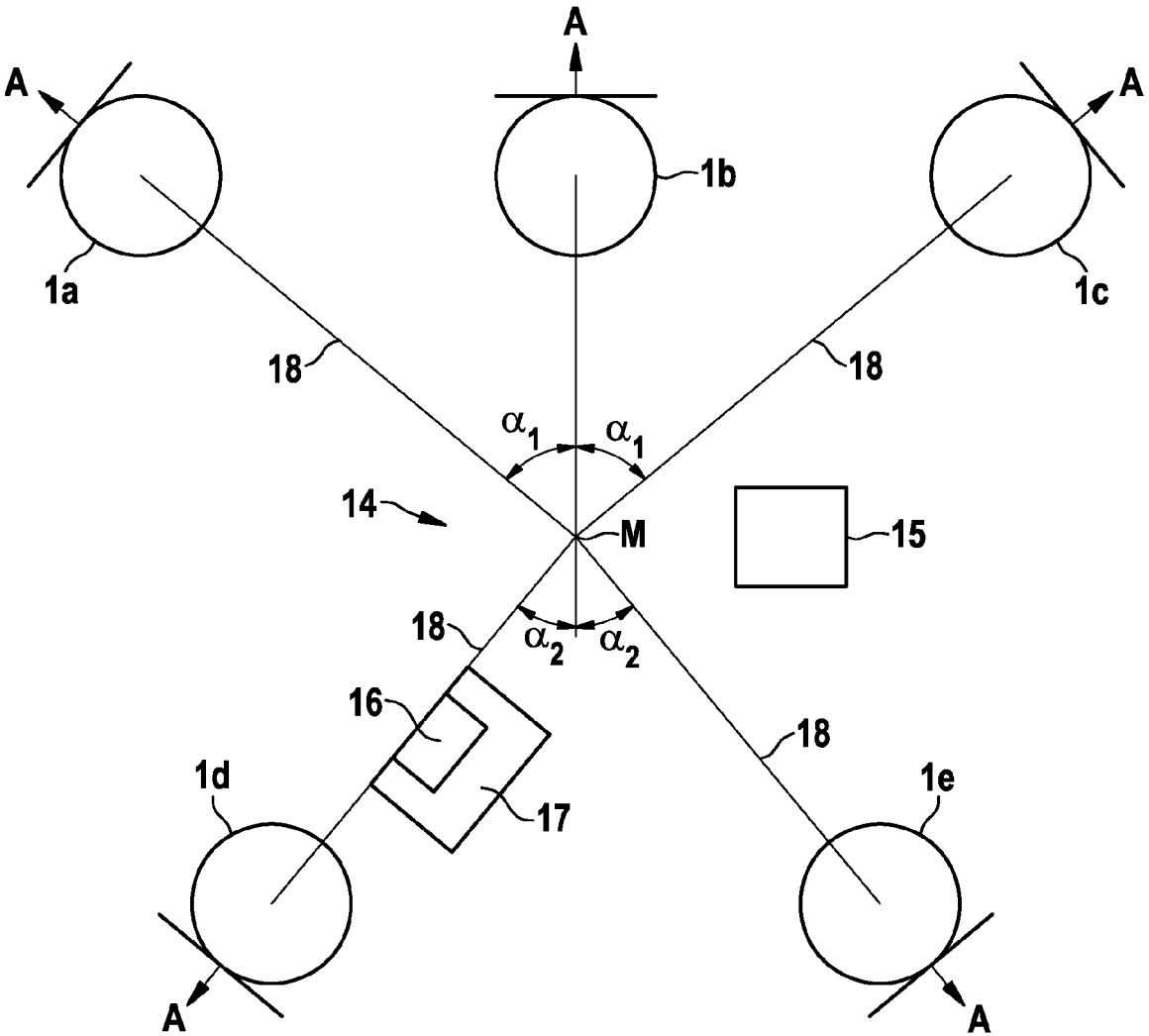
FIG. 2 is a diagrammatic plan view of an exemplary embodiment of a hydrophone assembly for stereophonic underwater sound recordings according to the invention.

FIG. 2 shows a hydrophone assembly according to an exemplary embodiment of the invention comprising three, preferably but not necessarily identical, hydrophones that are configured as described above. Such hydrophone assemblies comprising a plurality of hydrophones facilitate stereophonic sound recordings of very high quality by combining the directivities of the hydrophones 1 with propagation time differences between the hydrophones 1. While a microphone assembly in air at a distance between the outer microphones of 1 m is sufficient to achieve high-quality panoramic characteristics, a hydrophone assembly comprising a plurality of hydrophones distanced from each other by only 1 m cannot achieve directivity in an underwater environment. It is, therefore, assumed that the different sound propagation velocities in water and air must be taken into account when dimensioning the hydrophone assembly. As the relation of the average sound velocities underwater and the sound velocities in air is about 4.4, the distance between the hydrophones 1 in the hydrophone arrangement 10 was defined in a range between approximately 4 m and approximately 5 m, in particular, approximately 4.4 m.

FIG. 2 shows a hydrophone assembly comprising three front hydrophones 1*a*, 1*b*, 1*c* and two rear hydrophones 1*d*, 1*e*. The front hydrophones 1*a*, 1*b*, 1*c* are arranged in a row. The two outer front hydrophones 1*a* and 1*c* form an angle of 100° to 150°, with respect to their center M, between their directions of highest sensing sensitivity, their respective sensing directions (marked by arrows A) and the surface normal of their sensor areas 3. In an exemplary embodiment, the angle is 120°. In an alternative exemplary embodiment, the inner front hydrophone 1*b* can also be placed further toward the front (in the direction of its sensing direction) with respect to the two outer front hydrophones 1*a*, 1*c*.

The inner hydrophone 1*b* is positioned at an identical distance to the two outer hydrophones 1*a*, 1*c*. In relation to the two surface normals of the sensor areas 3 of the outer hydrophones 1*a*, 1*c* of the front hydrophones 1, the surface normal of the sensor area 3 of the inner hydrophone 1*b* of the front hydrophones 1 has the same angle $\alpha_1$, with respect to the center M, e.g., an angle between approximately 50° and approximately 75°, in particular, approximately 60°. The inner hydrophone 1*b* can be disposed between the two outer hydrophones 1*a*, 1*c* or can be shifted in the direction of the surface normal of the sensor area 3 or in the direction of highest sensing sensitivity.

The sensing directions of the two rear hydrophones 1*d*, 1*e* are directed toward the rear, i.e., in a direction towards a further half space that is different from the half space towards which the front hydrophones 1*a*, 1*b*, 1*c* are directed. The sensing directions of the rear hydrophones 1*d*, 1*e* form an angle between approximately 70° and approximately 110°, in particular, approximately 90°, with respect to the center M. In an exemplary embodiment, their sensing directions, in each case with respect to the center M, have identical angles of $\alpha_2$ between approximately 35° and approximately 55° to the reverse (turned by 180°) sensing direction of the inner front hydrophone 1*b*.

The hydrophones 1*a* to 1*e* can be disposed at a suitable base frame 14, which can for example be star-shaped, as illustrated in FIG. 2. The distance of the rear hydrophones 1*d*, 1*e* and the two outer front hydrophones 1*a*, 1*c* to the center M of the star-shaped base frame 14 is substantially identical. The configuration of the hydrophones 1*a* to 1*e* is selected such that the distance between the rear hydrophones 1*d*, 1*e* and the two outer front hydrophones 1*a*, 1*c* is between approximately 3 m and approximately 6 m, preferably between approximately 4 m and approximately 5 m, e.g., approximately 4.4 m. The distance between the two rear hydrophones 1*d*, 1*e* can be different from or identical to the distance between the front hydrophones 1*a*, 1*c*.

Figure 4:
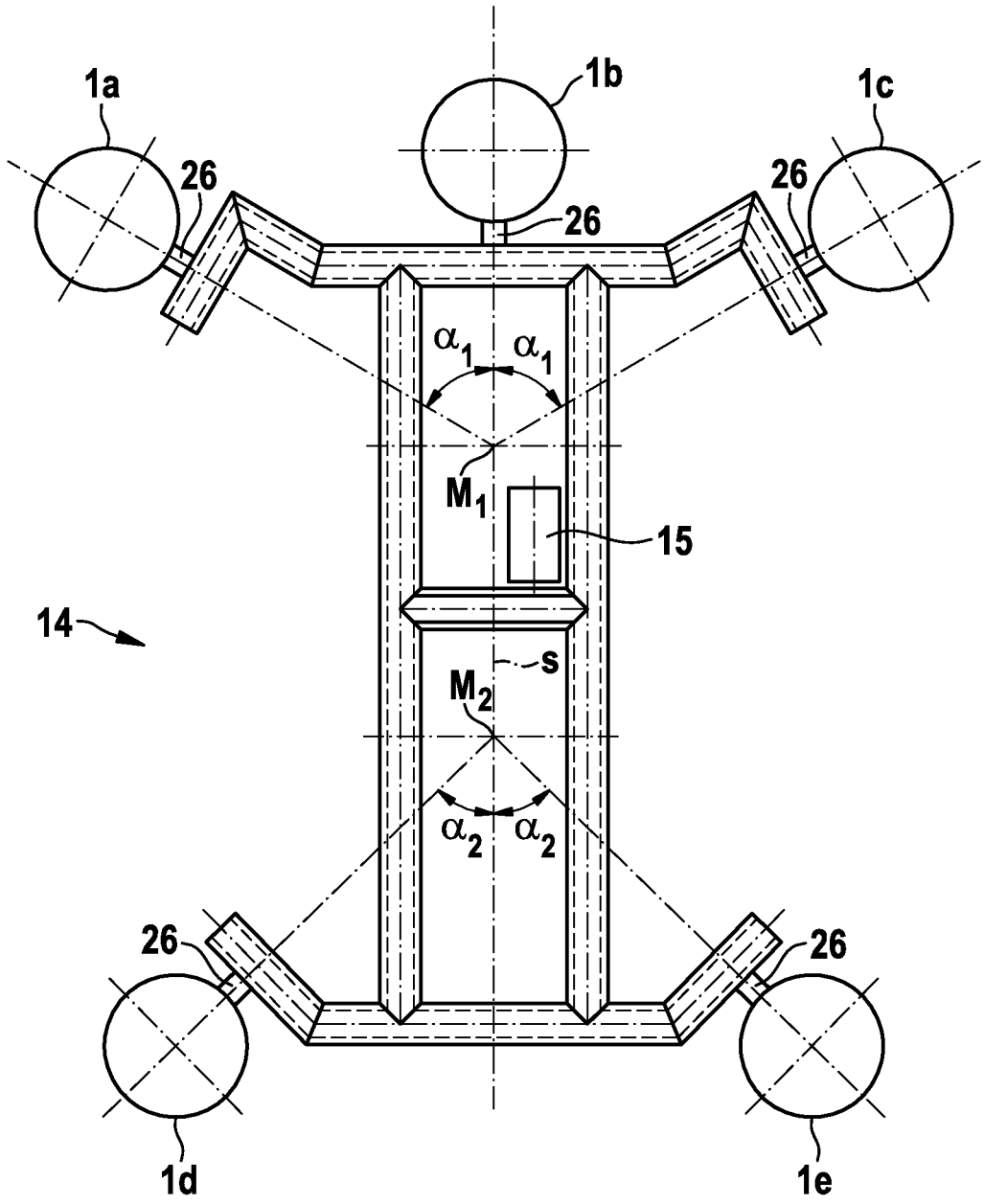
FIG. 4 is a further exemplary embodiment of a hydrophone assembly for stereophonic underwater sound recordings according to the invention.

In a further exemplary embodiment of a hydrophone assembly represented in FIG. 4, the front hydrophones 1*a*, 1*b*, 1*c* are disposed in relation to a first reference point M1 and the rear hydrophones 1*d*, 1*e* are disposed in relation to a second reference point M2 that is distanced from the first reference point M1. The reference points M1, M2, together with the inner hydrophone 1*b* of the front hydrophones 1*a*, 1*b*, 1*c* are located on a symmetry line S. The inner hydrophone 1*b* is disposed at an equal distance with respect to the two outer hydrophones 1*a*, 1*c*. The surface normal of the sensor area 3 of the inner hydrophone 1*b* of the front hydrophones 1, as in the embodiment according to FIG. 2, has the same angle $\alpha_1$ to the surface normals of the sensor areas 3 of the outer hydrophones 1*a*, 1*c* of the front hydrophones 1, e.g., an angle between approximately 50° and approximately 75°, in particular, approximately 60°. The inner front hydrophone 1*b* can be disposed between the two outer hydrophones 1 or offset in a direction towards the surface normal of the sensor area 3 or in a direction of its highest sensitivity.

The sensing directions of the two rear hydrophones 1*d*, 1*e* are directed toward the rear, i.e., in a direction toward a further half space that is different from the half space toward which the sensing directions of the front hydrophones 1*a*, 1*b*, 1*c* are directed. The sensing directions of the rear hydrophones 1*d*, 1*e* form an angle between approximately 70° and approximately 110°, in particular, approximately 90°, with respect to the second reference point M2. In an exemplary embodiment, each of the sensing directions has an identical angle $\alpha_2$ of between approximately 35° and approximately 55° with respect to the reverse (turned by 180) sensing direction of the inner front hydrophone 1*b*.

The hydrophones 1 of the above-described hydrophone assemblies are connected to a central recording unit 15 in which the evaluation of the electrical signals that are received from the hydrophones 1*a* to 1*e* is carried out. The central recording unit 15 is arranged outside the base frame 14 (e.g., on a boat). The base frame can be connected to the recording unit 15 through a suitable cable (not shown). In an exemplary embodiment, the cable is a tearproof cable, such as, for example, a KEVLAR® cable, which can also serve as a holding rope for the hydrophone assembly.

Furthermore, the connection between the base frame 14 and the recording unit 15 can be a radio connection, wherein the base frame 14 has a suitable energy supply, e.g., a battery, for operating the hydrophones 1, the amplifiers, and a suitable radio transmission device. Antennas can be placed around rods 18 of the base frame 14, so that an optimized emission of radio waves toward the water surface is ensured when the base frame is in a preferential horizontal alignment.

To ensure the operability of the hydrophone assembly during movement, a so-called hardware denoiser can be integrated in the recording unit 15. The hardware denoiser comprises a digital signal processor by which the formants of invariant background noise can be determined by fast Fourier transformation analysis. The invariant background noise thus determined (engine, generator, flow noise etc.) can then be removed from the sound spectrum or at least be reduced by anti-phase signals.

To prevent interferences, the grounding of the boat and the grounding of the electrical components and of the hydrophone 1 should be provided separately. The hydrophones 1, in particular, should not be connected to a common ground with other components.

As water is an acoustically inhomogeneous medium and the sound velocity therefore varies, the system's degree of efficiency may also vary depending on the location. Therefore, a velocimeter 16 can be provided at the base frame 14 and measures the current sound velocity underwater in a known manner. As the underwater sound velocity mainly depends on the pressure (i.e., the water depth), the temperature, and the salt content, it is useful to adapt the dimensions of the base frame 14 and/or the hydrophones 1. It is possible, for instance, to alter the distances between the hydrophones 1 by rods 18, the length of which can be varied, e.g., telescopic rods, in a manner depending on a sound velocity that is determined by the velocimeter 16. To this end, the velocimeter 1 can be equipped with a functional unit 17 that receives the determined sound velocity and calculates therefrom information on size or position for the base frame 14 and for the length of the individual rods 18, respectively, with the aid of a suitable function or characteristic function. With a display unit, the size or position information can be issued.

Alternatively, the functional unit 17 can utilize the determined sound velocity for adjusting the distances and the recording units by an automated adjusting device. To this end, one or more length-adjustable rods 18 can be electrically controllable telescopic rods in a way that allows the functional unit 17 to adjust the position in an automated manner by adjusting the length of the telescopic rod(s) depending on the sound velocity. Thereby, the base frame 14 is able to adjust to the current sound velocity and thus stabilize the degree of efficiency.

Figure 5:
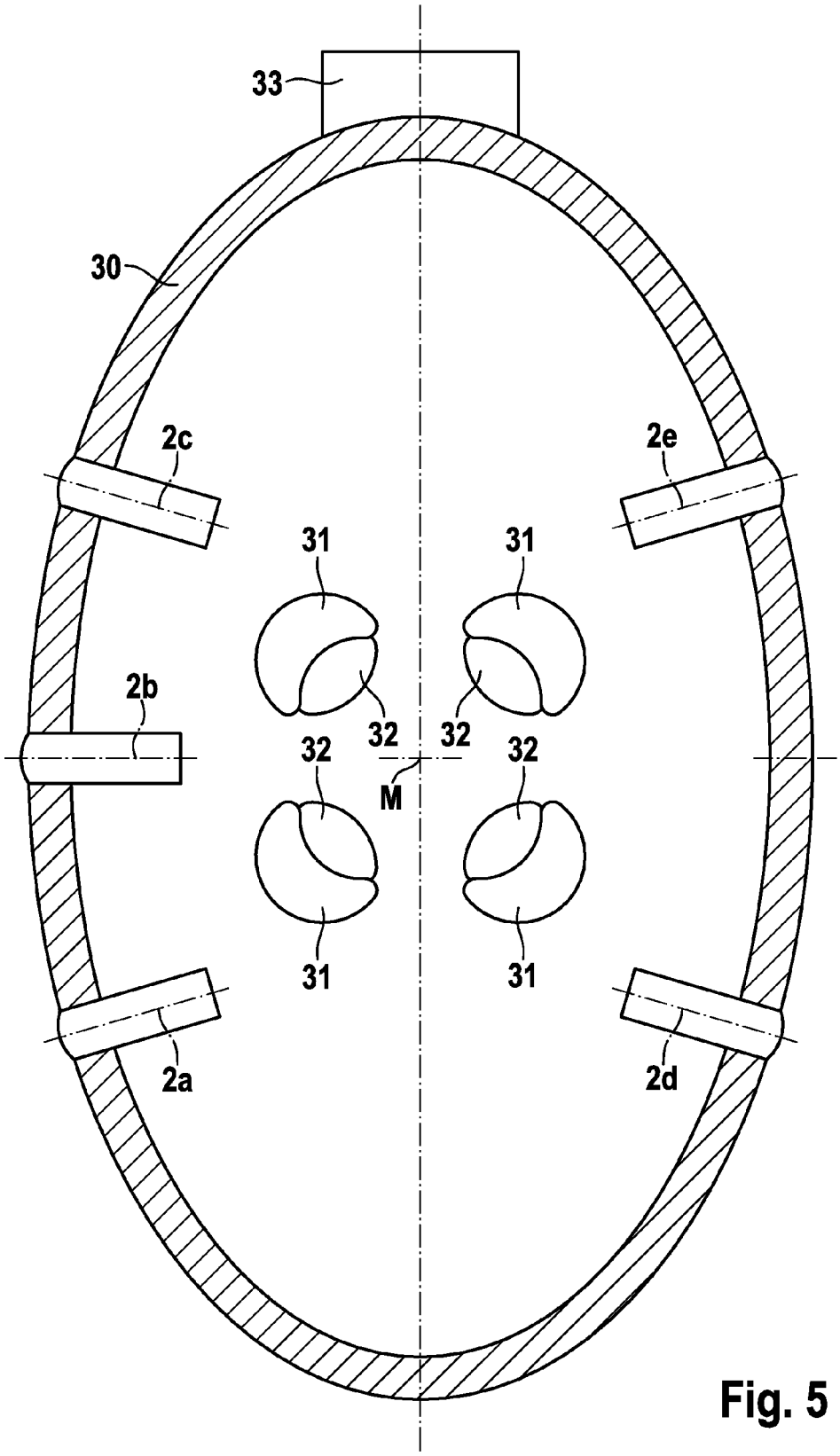
FIG. 5 a diagrammatic illustration of an exemplary embodiment of a holophone as a hydrophone with a number of vibration sensors according to the invention.

In a further exemplary embodiment, as illustrated in FIG. 5, the configuration of the hydrophone and the hydrophone assembly can be combined in a holophone unit 30. The holophone unit 30 corresponds to a hydrophone having a plurality of vibration sensors 2, the holophone unit 30 being in the shape of an ellipsoid body. The configuration of the assembly of the housing 4, as described above, also applies to the configuration of the ellipsoid body, i.e., the body can be a hollow body or a solid body. The ellipsoid body has a constructional dimension that corresponds to the dimensions of the hydrophone assembly. For instance, the longitudinal axis of the ellipsoid body has a length of between approximately 80 cm and approximately 1.50 m, for example, between approximately 1 m and approximately 1.30 m, and, in particular, approximately 1.20 m. The length of the lateral axis is between approximately 0.5 m and approximately 1.10 m, for example, between approximately 0.7 m and approximately 0.9 m, and, in particular, approximately 0.8 m.

The vibration sensors 2*a*, 2*b*, 2*c*, 2*d*, 2*e* can be disposed in the holophone unit 30 in a manner identical to the hydrophones 1*a*, 1*b*, 1*c*, 1*d*, 1*e* in the hydrophone assembly of FIG. 2. The angular ranges, in which the vibration sensors 2*a*, 2*b*, 2*c*, 2*d*, 2*e* are disposed with respect to the center M, correspond to those of the hydrophone assembly of FIG. 2.

In an exemplary embodiment, the ellipsoid body has a plurality of pressure chambers 31 that are accessible through a connector 33 from the outside. The pressure chamber 31 acts on a deformable body 32, like e.g., a water container having an outward opening (not shown), to adjust the buoyancy of the body of the holophone unit 30. Through the connector 33, an air tank of a diver can be directly connected to the pressure chamber 31 so that the diver can balance the holophone unit 30 according to the current water depth by letting air into and out of the pressure chamber 31.

The foregoing description and accompanying drawings illustrate the principles, exemplary embodiments, and modes of operation of the invention. However, the invention should not be construed as being limited to the particular embodiments discussed above. Additional variations of the embodiments discussed above will be appreciated by those skilled in the art and the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A hydrophone for detecting underwater sound, comprising:

a housing having a spherical shape and an outer surface serving as a bounding surface for an impinging sound wave and defining an opening, wherein the bounding surface is suitably shaped for obtaining a directivity of the impinging sound wave, the housing having a diameter providing a lower cut-off frequency for the directivity in an audible frequency range from approximately 50 Hz to approximately 16 kHz; and at least one vibration sensor having a sensor area for receiving sound waves and operable to provide a sensor signal, the sensor area:

being in the opening of the housing such that it closes the opening of the housing in a flush manner; and having a hemispherical attachment that is comprised of a damping material operable to reduce flow noise.

2. The hydrophone according to claim 1, wherein the housing has a diameter between approximately 15 cm and approximately 30 cm to have the lower cut-off frequency for the directivity be between approximately 1.5 kHz and approximately 3 kHz.

3. The hydrophone according to claim 2, further comprising a high-pass filter connected to the vibration sensor to filter the sensor signal, the high pass filter having a cut-off frequency corresponding to the lower cut-off frequency for the directivity.

4. The hydrophone according to claim 1, further comprising:

at least one housing extension element operable to be removably attached to the outer surface of the housing to form an extended outer surface; and a coupling material acoustically coupling a further sensor area to the sensor area flush to the opening of the housing.

5. The hydrophone according to claim 1, further comprising:

at least one housing extension element operable to be removably attached to the outer surface of the housing to form an extended outer surface; and a coupling material acoustically coupling a further sensor area to the sensor area flush to the extended outer surface.

6. The hydrophone according to claim 1, wherein:

the housing is ellipsoid in shape; and the at least one vibration sensor is a plurality of vibration sensors disposed in one plane, the vibration sensors each have a sensing direction as a direction of highest sensing sensitivity and the sensing directions of two of the vibration sensors form an angle between approximately 110° and approximately 150°.

7. The hydrophone according to claim 6, wherein the vibration sensors include an inner vibration sensor disposed between the two outer vibration sensors, the inner vibration sensor having a sensing direction directed along a bisecting line of the angle between the sensing directions of the two outer vibration sensors, the sensing directions of the outer and inner vibration sensors are directed toward a first half space.

8. The hydrophone according to claim 7, wherein the vibration sensors include two further vibration sensors having different sensing directions directed towards a second half space different from the first half space, the two further vibration sensors being disposed such that a bisecting line of an angle between the sensing directions thereof and the bisecting line of the angle between the sensing directions of the two outer vibration sensors are one of parallel and identical.

9. A hydrophone assembly, comprising:

a plurality of hydrophones for detecting underwater sound, each hydrophone comprising:

a housing having a spherical shape and an outer surface serving as a bounding surface for an impinging sound wave and defining an opening, wherein the bounding surface is suitably shaped for obtaining a directivity of the impinging sound wave, the housing having a diameter providing a lower cut-off frequency for the directivity in an audible frequency range from approximately 50 Hz to approximately 16 kHz; and at least one vibration sensor having a sensor area for receiving sound waves and operable to provide a sensor signal, the sensor area:

being in the opening of the housing such that it closes the opening of the housing in a flush manner; and having a hemispherical attachment that is comprised of a damping material operable to reduce flow noise.

10. The hydrophone assembly according to claim 9, wherein the plurality of hydrophones is at least three hydrophones disposed in a serial configuration.

11. The hydrophone assembly according to claim 10, wherein each two neighboring ones of the serially configured hydrophones have the same distance to each other.

12. The hydrophone assembly according to claim 9, wherein:

the hydrophones each have a sensing direction corresponding to a direction of the highest sensing sensitivity thereof; and the sensing directions of two outer ones of the hydrophones form an angle from approximately 110° to approximately 150°.

13. The hydrophone assembly according to claim 12, wherein:

an inner one of the hydrophones is disposed between two outer ones of the hydrophones;

a sensing direction of the inner hydrophone is directed along a bisecting line of the angle between the sensing directions of the outer hydrophones; and the sensing directions of all serially configured hydrophones are directed towards a first half space.

14. The hydrophone assembly according to claim 13, wherein:

the hydrophones comprise two further hydrophones each provided with different sensing directions directed towards a second half space different from the first half space and forming an angle therebetween of approximately 70° to approximately 110°; and the further hydrophones are disposed so that a bisecting line of the angle between the sensing directions thereof and the bisecting line of the angle between the sensing directions of the outer hydrophones of the serially configured hydrophones are one of parallel and identical.

15. A method for operating hydrophones for stereophonic underwater sound recordings in an audible frequency range, which comprises:

placing at least two hydrophones for detecting underwater sound in water, each of the at least two hydrophones comprising:

a housing having a spherical shape and an outer surface serving as a bounding surface for an impinging sound wave and defining an opening, wherein the bounding surface is suitably shaped for obtaining a directivity of the impinging sound wave, the housing having a diameter providing a lower cut-off frequency for the directivity in an audible frequency range from approximately 50 Hz to approximately 16 kHz; and at least one vibration sensor having a sensor area for receiving sound waves and operable to provide a sensor signal, the sensor area:

being in the opening of the housing such that it closes the opening of the housing in a flush manner; and having a hemispherical attachment that is comprised of a damping material operable to reduce flow noise; and carrying out underwater stereophonic sound recordings in an audible frequency range with the at least two hydrophones.

16. The hydrophone according to claim 1, wherein the housing is comprised of a hard shell.

* * * * *